United States Patent [19]

Arakawa et al.

[11] Patent Number: 4,984,289

[45] Date of Patent: Jan. 8, 1991

[54] APPARATUS FOR CONTROLLING UNDERGROUND EXCAVATOR

[75] Inventors: Shuji Arakawa; Tatsuo Mimura, both of Kanagawa, Japan

[73] Assignee: Kabushiki Kaisha Komatsu Seisakusho, Tokyo, Japan

[21] Appl. No.: 309,726

[22] PCT Filed: Jul. 30, 1987

[86] PCT No.: PCT/JP87/00566

§ 371 Date: Jan. 30, 1989

§ 102(e) Date: Jan. 30, 1989

[87] PCT Pub. No.: WO88/01012

PCT Pub. Date: Feb. 11, 1988

[30] Foreign Application Priority Data

Jul. 31, 1986 [JP] Japan ..... 61-182079

[51] Int. Cl.[5] ..... F16L 1/00

[52] U.S. Cl. ..... 405/184; 405/154; 299/1

[58] Field of Search ..... 405/184, 154, 303; 175/45, 61, 62, 73, 19; 299/1

[56] References Cited

U.S. PATENT DOCUMENTS

| | | | |
|---|---|---|---|
| 3,529,682 | 9/1970 | Coyne | 175/45 |
| 3,589,454 | 6/1971 | Coyne | 175/45 X |
| 3,907,045 | 9/1975 | Dahl et al. | 299/1 X |
| 4,026,371 | 5/1977 | Takada et al. | 175/45 |
| 4,733,733 | 3/1988 | Bradley et al. | 175/61 X |

FOREIGN PATENT DOCUMENTS

| | | |
|---|---|---|
| 5187 | 2/1944 | Japan . |
| 3794 | 1/1981 | Japan . |
| 118993 | 7/1984 | Japan . |
| 161596 | 9/1984 | Japan . |
| 230498 | 11/1985 | Japan . |
| 238600 | 11/1985 | Japan . |
| 104219 | 5/1986 | Japan . |
| 84807 | 6/1986 | Japan . |
| 134495 | 6/1986 | Japan . |

OTHER PUBLICATIONS

"Apparatus for Detecting Location of a small-caliber pipe propelling device", Publication Document at Symposium on Construction Machine and Working Method held in 1986.

"Developing Burrowing Technology", Part I, NTT Shisetsu 37-3.

"Developing Burrowing Technology", (Part III), NTT Shisetsu 37-5.

"Method of Constructing a Small-caliber Tunnel", Tsuken Geppoh 37-9, 1984.

*Primary Examiner*—Dennis L. Taylor

*Attorney, Agent, or Firm*—Spensley Horn Jubas & Lubitz

[57] ABSTRACT

With respect to correcting of a forward movement course of the underground excavator, the control apparatus is so constructed that a positional deviation of the pilot head (20) relative to an excavation planned value is obtained on the basis of detecting of the existent position assumed by the pilot head (20) and the excavation angle correcting means (S1, S2, 21, 23, 41, 71, 72, 73, 80) is provided for automatically correcting an excavating angle of the excavating head (10) on the basis of the positional deviation so as to allow controlling to be achieved automatically. With respect to controlling of start and stop of excavating operation to be performed by the underground excavator, an arrangement is made such that controlling is semiautomatically achieved using the commanding means (74) disposed in the start pit (SH) to issue commands indicative of start and stop of propelling operation of the propelling jack (40) in response to proper manual handling performed by an operator (M) staying on the bottom of the start pit (SH).

2 Claims, 6 Drawing Sheets

D: DEPTH AT WHICH MAGNETIC FIELD DETECTORS ARE PLACED

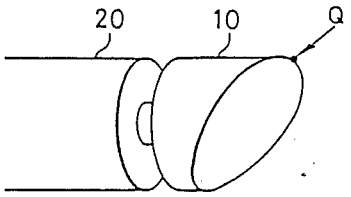
FIG. 8
FIG. 9 (a)
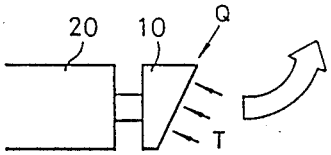
FIG. 9 (b)
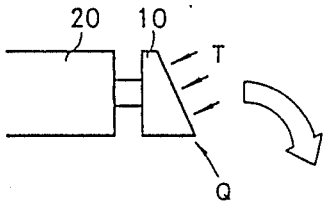
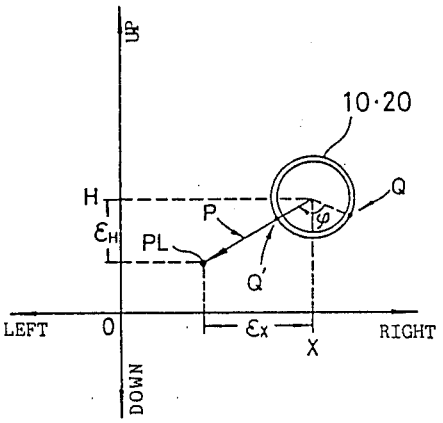
FIG. 10

APPARATUS FOR CONTROLLING UNDERGROUND EXCAVATOR

TECHNICAL FIELD

The present invention relates to an apparatus for controlling an underground excavator adapted to excavate a tunnel through which a water piping, a gas piping or the like extend in the underground while it is propelled therethrough in accordance with an excavation planned line and more particularly to practical realization of an apparatus preferably employable for semiautomatically controlling an underground excavator.

BACKGROUND ART

Generally, an iron-mole class underground excavator, a tunnel excavating machine or the like is operated such that a position where it is installed in the underground is measured using a laser beam in order to perform excavating operation as planned. However, it has been found that a conventional excavator of the above-mentioned type has a drawback that it is considerably difficult to measure the position using laser beam, because when a tunnel is excavated to bury a water piping, a gas piping or the like in the underground, a number of pipes having a very small diameter (e.g. a diameter of about 100 mm) are successively used during excavating operation and moreover the excavating operation is often performed while following a curved course. Namely, as far as an underground excavator of the type using pipes having a very small diameter to perform excavating operation is employed, it is difficult to reserve an optical passage through which a laser beam is propagated (because hydraulic hoses, electric cables and a variety of supporting means are accommodated in the form of a crowded assembly in the interior of a piping having a very small diameter, resulting in a sufficient space for allowing a laser beam to be propagated through the optical passage failing to be reserved in the piping. Even if such an optical passage can be reserved in the piping, it is practically impossible that the underground excavator performs excavating operation using a laser beam while following a curved course, because a laser beam is propagated only through a straight optical passage.

In recent years, in view of the foregoing drawback, a method of measuring a position where an underground excavator is installed in the underground, using a magnetic field in place of a laser beam has been already proposed and put in practical use for the purpose of excavating a tunnel using pipes having a very small diameter for the underground excavator.

FIG. 5 schematically illustrates a conventional method of measuring a position where an underground excavator is placed in the underground, utilizing a magnetic field. A hitherto employed method of excavating a tunnel using the underground excavator will be described below with reference to FIG. 5.

In the drawing, reference characters EP designate a ground surface, reference characters SH refer to a start pit, reference characters EH refer to a target pit, reference numeral 10 refers to an excavating head for the underground excavator, reference numeral 20 refers to a pilot head for the underground excavator, reference numeral 21 refers to a hydraulic motor accommodated in the pilot head 20 to adjust a turning angle of the excavating head 10, reference numeral 22 refers to a magnetic field generating element accommodated also in the pilot head 20 to generate a magnetic field extending in the form of a sprayed water stream, reference numeral 23 refers to an inclination measuring instrument accommodated also in the pilot head 20 to detect an inclination of the pilot head 20 relative to a horizontally extending plane, reference numerals 30 (30*a*, 30*b*, 30*c*) refer to a number of rod pipes adapted to be successively connected to the rear end of the pilot head 20 one after another, reference numeral 40 refers to a propelling jack for propelling the excavating head 10 and the pilot head 20 toward the target pit EH by allowing the rod pipes 30 to be successively displaced in the forward direction, reference numeral 41 refers to a propelled distance detector disposed at a suitable location on the propelling jack 40 to detect a propelled distance as measured from the start pit SH to the pilot head 20 based on the number of used rod pipes 30, reference numeral 50 refers to a main control board installed on the ground, reference numeral 51 refers to a handling board on the main control board 50, reference numeral 52 refers to a hydraulic power source mounted in the main control board 50 to feed a required quantity of hydraulic power to the hydraulic motor 21, reference numeral 53 refers to a sender accommodated in the main control board 50 to feed a required quantity of electric power to the magnetic field generating element 22 for the purpose of generating the magnetic field, and reference numeral 60 refers to a magnetic field generating source searcher for measuring a position where the pilot head 20 is placed in the underground, as viewed in the transverse direction by searching for the magnetic field generated by the magnetic field generating element 22 on the ground surface EP as shown in the drawing.

Referring to FIG. 5, according to the conventional method, the underground excavator is operated in cooperation of an operator M1 standing on the ground for handling the main control board 50 mounted thereon with an operator M2 staying on the bottom of the start pit SH to connect a rod pipe 30 to the rear end of the pilot head 20 or disconnect it therefrom.

For example, propelling of the underground excavator is performed by way of the following steps.

first step: The operator M1 standing on the ground stops operation of the underground excavator by handling the main control board 50 installed on the ground.

second step: The operator M2 staying in the start pit SH confirms by a sign given by the operator M1 or in a visual manner that operation of the underground excavator has been stopped.

third step: The operator M2 successively connects rod pipes 30 to the rear end of the pilot head 20 of the underground excavator one after another.

fourth step: The operator M1 confirms by a sign given by the operator M2 or in a visual manner that successive connection of the rod pipes 30 to to the pilot head 20 has been completed.

fifth step: The operator M1 handles the main control board 50 for the underground excavator so as to allow the latter to be propelled to excavate a tunnel. It should be noted that a propelled distance corresponds to a length of all the connected rod pipes 30.

After excavating operation has been completed by way of the above-mentioned steps, it returns to the first step again.

Incidentally, when a position as viewed in the transverse direction where the underground excavator is placed in the underground is to be measured, measurement of the position is achieved by searching for a sprayed water-shaped magnetic field generated by the magnetic field generating element 22 received in the pilot head 20 on the ground surface using the magnetic field generating source searcher 60. In addition, the position as viewed in the vertical direction is calculated in the handling board 51 on the basis of an output from the inclination measuring instruments 23 and an output from the propelled distance detector 41 so that results derived from the calculation are displayed on a display DP on the main control board 50. In response to information on the above position, the operator M1 corrects a forward movement course of the underground excavator (particularly, pilot head 20) by adjusting a turning angle of the excavating head 10 via the hydraulic motor 21 (of which driving is controlled by properly handling the handling board 51).

As described above, to practice the conventional method, operations for exchanging signs between two cooperators and visually confirming the current state of the underground excavator are required particularly during the steps 2 and 4. However, exchanging of signs between two cooperators and visual confirmation as mentioned above have the following problems.

(1) In a case where a sign is exchanged between two cooperators via voice, there arises such a situation that the voice serving as a sign can be heard by them with much difficulties due to noisy sound generated by the power source for the underground excavator (e.g. hydraulic pump, electric motor) as well as noisy sound generated by the surrounding traffic. Indeed, since the start pit usually has a depth more than 4 m, vocal communication between an operator on the ground and an operator in the pit can be achieved only with much difficulties.

(2) In a case where a sign is exchanged between two cooperators by their hands or using a sign board, structural articles arranged in the interior of the pit or above the pit for the purpose of assuring their safety provide an obstacle for the field of view. Further, with a deep pit used, a see-through can be hardly attained between the ground and the bottom of the pit, causing confirmation of a sign via their hands or sign boards carried by them to be achieved with much difficulties.

(3) Visual confirmation of the current state of the underground excavator is unreliable, because there does not exist any communication between cooperators on both locations.

The above-mentioned problems (1) to (3) are very dangerous for the cooperators, because they do not remain within the range where excavating operation can be easily performed and moveover if incorrect confirmation is made, there is a danger that human body's accident takes place due to an occurrence of unintentional movement of the underground excavator during connecting or disconnecting operation performed for the rod pipes by the operator staying in the pit.

The present invention has been made with the foregoing problems (1) to (3) in mind and its object resides in providing an apparatus for controlling an underground excavator which assures that the problems are completely obviated and improved workability and protection of the operator staying in the pit from dangerous circumstances are achieved.

DISCLOSURE OF THE INVENTION

According to the present invention, the apparatus for controlling an underground excavator is constructed so as to allow controlling to be semiautomatically performed on the assumption that a position where a pilot head is placed in the underground is measured utilizing a magnetic field in such a manner as described above, wherein the apparatus includes excavating angle correcting means adapted to obtain a positional deviation of the pilot head relative to an excavation planned value on the basis of detection of the existent position where the pilot head is placed in the underground and then automatically correct the excavating angle of an excavating head on the basis of the positional deviation obtained in that way and commanding means disposed in the interior of a start pit to issue commands indicative of start and stop of propelling operation of a propelling jack by proper manual handling.

With such construction, correcting of a forward movement course of the underground excavator can be automatically controlled by provision of the excavating angle correcting means. Further, while correcting of the forward movement course of the underground excavator is automatically controlled, start and stop of excavating operation to be performed by the underground excavator are executed by handling the commanding means by an operator staying on the bottom of the pit. Namely, when the operator staying in the pit performs connecting or disconnecting operation for rod pipes, he stops excavating operation to be performed by the underground excavator by activating the commanding means and on completion of the connecting or disconnecting operation for rod pipes, he starts the excavating operation via the commanding means. Then, the above-mentioned operations are repeated at predetermined times.

As will be apparent from the above description, there is no necessity for an operator standing on the ground and at the same time there is no necessity for communication between an operator standing on the ground and an operator staying in the pit.

It should be added that operation for remounting the main control board which has been mounted on the ground on the bottom of the pit as it is and operation for allowing the operator staying in the pit to correct the forward movement course and start or stop excavating operation should not be practically performed in site unless correcting of the forward movement course of the underground excavator is achieved automatically. Specifically, provided that the main control board mounted on the ground should be remounted on the bottom of the pit, there naturally arises a necessity for enlarging the pit itself and this leads to increased expenditure required for boring the pit and increased region where provision of a vehicle road is restricted. Additionally, since handling of the main control board requires a skill to some extent, an unskilled operator who should practically perform various operations while staying in the pit can not necessarily deal with handling of the main control board.

In this regard, the apparatus of the invention is constructed such that commanding means requiring only so-called on/off operations is provided in the pit. Thus, such a problem as mentioned above does not arise.

BRIEF DESCRIPTION OF THE DRAWINGS

FIG. 8 is a perspective view illustrating construction of an excavating head for the underground excavator, FIGS. 9(*a*) and (*b*) are views schematically illustrating a relationship between the excavating head and a manner of correcting a forward movement course of the same, respectively and FIG. 10 is a schematic view illustrating a method of correcting the forward movement course using the apparatus in accordance with the embodiment.

BEST MODE FOR CARRYING OUT THE INVENTION

Now, the present invention will be described in a greater detail hereinafter with reference to the accompanying drawings which illustrate a preferred embodiment thereof.

First, description will be made below with reference to FIGS. 6 to 10 as to a principle of operations of an apparatus in accordance with the embodiment of the present invention.

Figure 6:
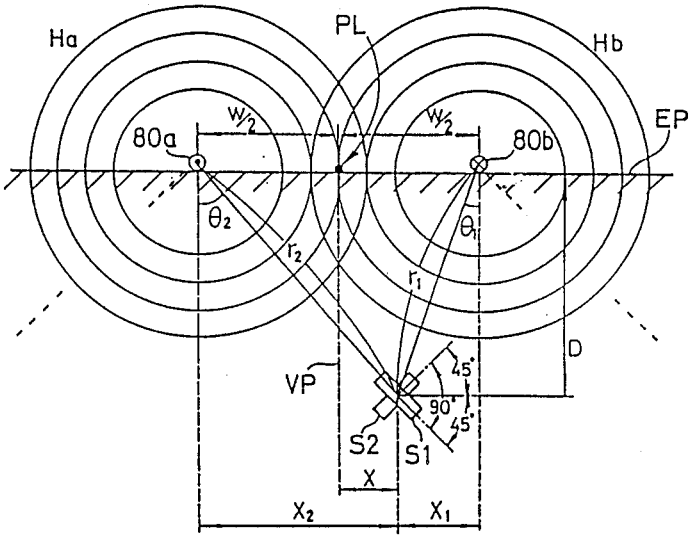
FIG. 6 is a schematic view illustrating a principle of performing measurements using the apparatus in accordance with the embodiment.

Now, as shown in FIG. 6, it is assumed that a magnetic field generating cable 80 comprising a going line 80*a* and a returning line 80*b* spaced from one another by a predetermined distance is laid on a ground surface EP and a properly determined intensity of electric current is caused to flow therethrough. This causes magnetic fields Ha and Hb to be concentrically generated in such a manner as shown in the drawing in the surrounding regions which extend radially from the going line 80*a* and the returning line 80*b* constituting the magnetic field generating cable 80. According to the embodiment which will be described in more details later, the magnetic fields Ha and Hb as generated in this way are simultaneously detected using magnetic field detecting elements S1 and S2. For the sake of simplification of description it is assumed that two magnetic field detecting elements S1 and S2 have magnetic field detecting directions which intersect each other at right angles and are inclined by 45 degrees relative to a plane extending perpendicularly through the cable 80. When a plurality of parameters are set in the following manner under the foregoing conditions as shown in FIG. 6, a level ratio of the magnetic field detected by the magnetic field detecting element S1 to the magnetic field detected by the magnetic field detecting element S2 is represented by R in accordance with the following formula.

W: distance between the going line and the returning line constituting the magnetic field generating cable 80

D: depth of the magnetic field detecting elements S1 and S2 which are placed in the underground $r_1$, $r_2$ distance between the magnetic field generating cable 80 and the magnetic field detecting elements S1 and S2

X: displacement of the magnetic field detecting elements S1 and S2 from the center between the going and returning lines (representative of an excavation planned line PL)

$X_1$: displacement of the magnetic field detecting elements S1 and S2 from the cable returning line 80*b* as measured in the horizontal direction $X_2$: displacement of the magnetic field detecting elements S1 and S2 from the cable going line 80*a* as measured in the horizontal direction $\theta_1$: angle formed by the plane extending perpendicularly through the cable returning line 80*b* and the plane extending from the latter to the magnetic field detecting elements S1 and S2

$\theta_2$: angle formed by the plane extending perpendicularly through the cable going line 80*a* and the plane extending from the latter to the magnetic field detecting elements S1 and S2

$$R=(V_{11}+V_{21})/(V_{12}+V_{22}) \quad (1)$$

where $V_{11}$, $V_{21}$, $V_{12}$ and $V_{22}$ represent a value calculated under a condition of combination of the going and returning lines 80*a* and 80*b* constituting the magnetic field generating cable 80 with two magnetic field detecting elements S1 and S2, respectively. For example, when it is assumed that the direction of rightward displacement indicates a positive direction, the respective parameters as noted above are represented in the following.

$$X_1 = X - (W/2) \quad (2)$$

$$X_2 = X + (W/2)$$

$$r_1 = \sqrt{D^2 + X_1^2}$$

$$r_2 = \sqrt{D^2 + X_2^2}$$

$$\theta_1 = |\tan^{-1}(X_1/D)|$$

$$\theta_2 = |\tan^{-1}(X_2/D)|$$

Then, when $V_{11}$, $V_{21}$, $V_{12}$ and $V_{22}$ are represented using the above parameters, the following formulas are obtainable.

$$\begin{cases} V_{11} = (1/r_1) \times \sin(45^\circ - \theta_1) \\ \text{where } X_1 \leqq -D \\ V_{11} = (1/r_1) \times \sin(45^\circ - \theta_1) \\ \text{where } -D < X_1 \leqq O \\ V_{11} = (1/r_1) \times \cos(45^\circ - \theta_1) \\ \text{where } O < X_1 \leqq D \\ V_{11} = (1/r_1) \times \cos(\theta_1 - 45^\circ) \\ \text{where } D < X_1 \end{cases} \quad (3)$$

$$\begin{cases} V_{21} = (1/r_2) \times \sin(\theta_2 - 45^\circ) \\ \text{where } X_2 \leqq -D \\ V_{21} = (1/r_2) \times \sin(\theta_2 - 45^\circ) \\ \text{where } -D < X_2 \leqq O \\ V_{21} = -(1/r_2) \times \cos(45^\circ - \theta_2) \\ \text{where } O < X_2 \leqq D \\ V_{21} = -(1/r_2) \times \cos(\theta_2 - 45^\circ) \\ \text{where } D < X_2 \end{cases} \quad (4)$$

$$\begin{cases} V_{12} = -(1/r_1) \times \cos(\theta_1 - 45^\circ) \\ \text{where } X_1 \leqq -D \\ V_{12} = -(1/r_1) \times \cos(\theta_1 - 45^\circ) \\ \text{where } -D < X_1 \leqq O \\ V_{12} = (1/r_1) \times \sin(\theta_1 - 45^\circ) \\ \text{where } O < X_1 \leqq D \\ V_{12} = (1/r_1) \times \sin(\theta_1 - 45^\circ) \\ \text{where } D < X_1 \end{cases} \quad (5)$$

$$\begin{cases} V_{22} = (1/r_2) \times \cos(45^\circ - \theta_2) \\ \text{where } X_2 \leqq -D \\ V_{22} = (1/r_1) \times \cos(45^\circ - \theta_2) \\ \text{where } -D < X_2 \leqq O \\ V_{22} = (1/r_2) \times \sin(45^\circ - \theta_2) \\ \text{where } O < X_2 \leqq D \\ V_{22} = (1/r_2) \times \sin(45^\circ - \theta_2) \\ \text{where } D < X_2 \end{cases} \quad (6)$$

Figure 7:
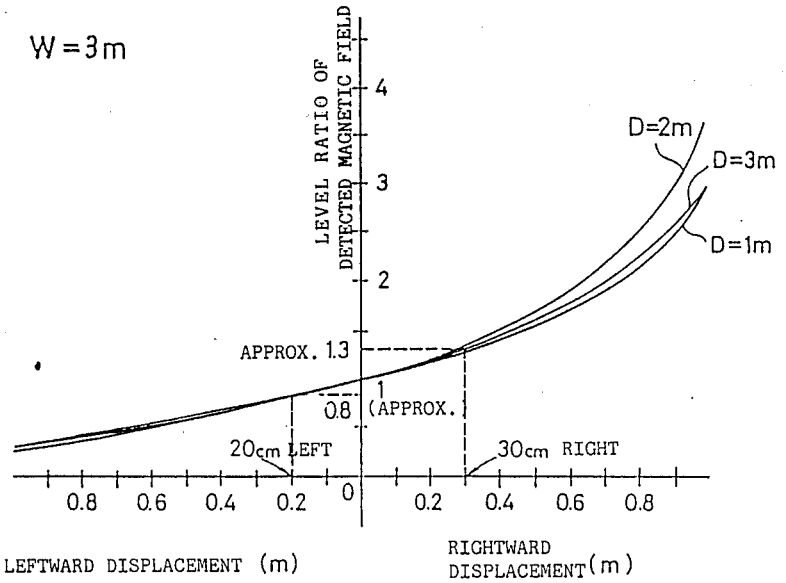
FIG. 7 is a graph illustrating a relationship between a level ratio of magnetic field detected by one of two magnetic field detecting elements as shown in FIG. 6 to magnetic field detected by the other one and an amount of horizontal displacement from the center located between the detected magnetic fields.

A relationship between an amount of horizontal displacement in meter and a level ratio R corresponding to the latter derived when values of $V_{11}$, $V_{21}$, $V_{12}$ and $V_{22}$ in these formulas (3) to (6) are put in the preceding formula (1) is illustrated by way of a graph in FIG. 7. The graph shown in FIG. 7 represents a relationship between a level ratio R of the magnetic field detected by the magnetic field detecting element S1 to the magnetic field detected by the magnetic field detecting element S2 for each of three underground depths supposed in the form of D=1 m, 2 m and 3 m and an amount of horizontal displacement as measured from the magnetic field detecting elements S1 and S2 to the plane VP extending perpendicularly through the center between the going and returning lines (representative of an excavation planned line PL).

Here, referring to the graph in FIG. 7, when two magnetic field detecting elements S1 and S2 placed under the aforementioned conditions are located in the perpendicularly extending plane VP which coincides with the center between the going and returning lines, i.e. located at a position represented by horizontal displacement amount =O, it is obvious that a level ratio of the magnetic field detected by one magnetic field detecting element to the magnetic field detected by the other magnetic field detecting element assumes a value of 1 irrespective of the current value of the underground depth D at which the magnetic field detecting elements S1 and S2 are situated in the underground. However, in a case where the magnetic field detecting elements S1 and S2 are displaced from the position identified by horizontal displacement amount=O toward the right half region, the level ratio R is represented by the following inequality.

$$R > 1$$

On the contrary, in a case where they are displaced therefrom toward the left half region, the level ratio R is represented by the following inequality.

$$R < 1$$

It should be noted that there does not appear any exception other than the foregoing cases. In addition, when such a method of measuring a horizontal displacement as mentioned above is employed, results derived from measurements are hardly affected by the underground depth D at which the magnetic field detecting elements are placed.

To sum up, it can be concluded that when a level ratio R of the magnetic field detected by the magnetic field detecting element S1 to the magnetic field detected by the magnetic field detecting element S2 is represented by R=1, provided that the magnetic field generated by the going and returning lines of the magnetic field generating cable 80 is detected by two magnetic field detecting elements S1 and S2 having magnetic field detecting directions which intersect each other at right angles and each of which is maintained in an inclined state by 45 degrees relative to the plane extending perpendicularly through either of the going and returning lines of the magnetic field generating cable 80, the magnetic field detecting elements S1 and S2 are located at a position identified by horizontal displacement amount=O relative to the center between the going and returning lines of the magnetic field generating cable 80, when the level ratio R is represented by R>1, the magnetic field detecting elements S1 and S2 are located at a position offset from the center between the going and returning lines of the magnetic field detecting cable 80 toward the right half region, and when the level ratio R is represented by R<1, the magnetic field detecting elements S1 and S2 are located at a position offset from the center between the going and returning lines of the magnetic field generating cable 80 toward the left half region. Additionally, each amount of displacement of the magnetic field detecting elements S1 and S2 can be also obtained in dependence of a value of the level ratio R as mentioned above. It should be noted that the foregoing amounts of displacement correspond to the level ratio R substantially irrespective of the underground depth D at which the magnetic field detecting elements S1 and S2 are placed in the underground.

Incidentally, an angle at which two magnetic field detecting elements S1 end S2 are arranged relative to the plane extending perpendicularly through either of the going and returning lines of the magnetic field generating cable has been defined in the above-described manner but the present invention should not be limited only to this definition. Basically, provided that directions of detecting of the magnetic fields assumed by the magnetic field detecting elements S1 and S2 are maintained at such an angle that they are arranged symmetrically relative to the plane extending perpendicularly through the center between the going and returning lines of the magnetic field generating cable, measurement can be performed with respect to a manner of measuring the horizontal displacement in accordance with the same principle as the above-described one.

Next, description will be made below with reference to FIG. 5 as to a principle of measuring a position as viewed in the vertical direction where a pilot head 20 employable for practicing the illustrated embodiment of the present invention is placed.

Figure 5:
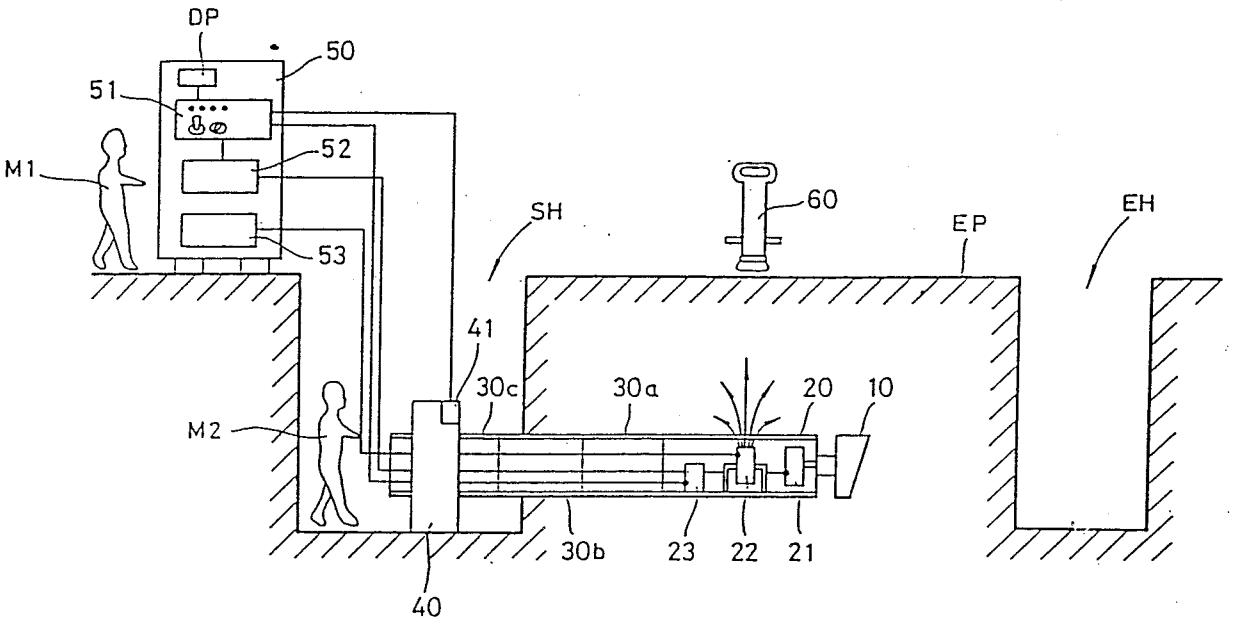
FIG. 5 PRIOR ART
FIG. 5 is a cross-sectional view schematically illustrating a hitherto employed underground excavator and an outline of manner for performing excavating operation using the underground excavator.

When an inclination measuring instrument 23 placed in the pilot head 20 usable for an underground excavator as shown in FIG. 5 is used, a pitching angle (represented by O) of the pilot head 20 can be measured. As mentioned above, a propelling jack 40 installed on the bottom of a start pit SH is provided with a propelled distance measuring instrument 41 (incorporated therein) so that a propelled distance (represented by L) by which the pilot head 20 moves forwardly can be measured using it. Thus, by using the pitching angle O and the propelled distance L, the existent vertical position assumed by the pilot head 20 relative to the excavation planned line (PL) is calculated in the following manner when it is represented by H.

$$H = \sum_{i=1}^{n} \Delta Hi$$

$$H = \sum_{i=1}^{n} (\Delta Li \times \sin\Delta\theta i)$$

where n: number of propelling operations performed till now (representing the number of rod pipes 30 which have been used till now)

ΔHi: vertical position assumed by the pilot head at an i time among a number of propelling operations)

$\Delta\theta i$: pitching angle assumed by it at an i time among a number of propelling operations)

ΔLi: propelled distance per one propelling operation (equal to a known length of the rod pipe 30)

Next, description will be made below as to how the direction of forward movement course of the underground excavator (particularly, the pilot head 20 used therefor) should be corrected on the basis of results derived from position measurement in that way.

FIG. 8 shows an excavating head 10 usable for the underground excavator. As is apparent from the drawing, the excavating head 10 has a tapered fore end (for the sake of convenience of description, the tapered fore end part being identified by Q as shown in the drawing). Thus, as shown in FIG. 9(*a*), the head 10 is situated to receive a ground pressure T from the below when its fore end part Q is located at an upper position, causing the head 10 and the pilot head 20 to be corrected upwardly. On the contrary, as shown in FIG. 9(*b*), the head 10 is situated to received a ground pressure T from the above when its fore end part Q is located at a lower position, causing the head 10 and the pilot head 20 to be corrected downwardly.

FIG. 10 illustrates a method of controlling such an excavating head 10 as mentioned above.

Now, for example it is assumed that the excavating head 10 assumes a position X as viewed in the transverse direction and a position H as viewed in the vertical direction as results of the aforementioned position measurement. To allow the excavating head 10 and the pilot head 20 to come near to the excavation planned line PL, the direction of correction of the excavating head 10 and the pilot head 20 should coincide with the direction along which a deviation $\epsilon_X$ from the excavation planned line PL as viewed in the transverse direction as well as a deviation $\epsilon_H$ from the same as viewed in the vertical direction are simultaneously eliminated, i.e. the direction as identified by an arrow mark P in the drawing. To this end, it suffices that the existent position assumed by the fore end part Q of the excavating head 10 is turned by an angle $\psi$ until the fore end part Q reaches a position as identified by Q. As the excavating head 10 and the pilot head 20 are propelled while the fore end part Q of the excavating head 10 is located at the position represented by Q', the direction of forward movement course of the underground excavator can be corrected in such a manner as to follow the excavation planned line PL.

According to the present invention, all operations ranging from position measurement to correction of forward movement course are performed automatically and only controlling on start and stop of propelling of the excavating head 10 and the pilot head 20 is performed manually.

FIGS. 1 to 4 show an apparatus for controlling an underground excavator in accordance with an embodiment of the present invention wherein the apparatus is constructed in accordance with the above-described principle. Now, construction and operation of the apparatus in accordance with the embodiment will be described in more details hereinafter with reference to FIGS. 1 to 4.

Figure 1:
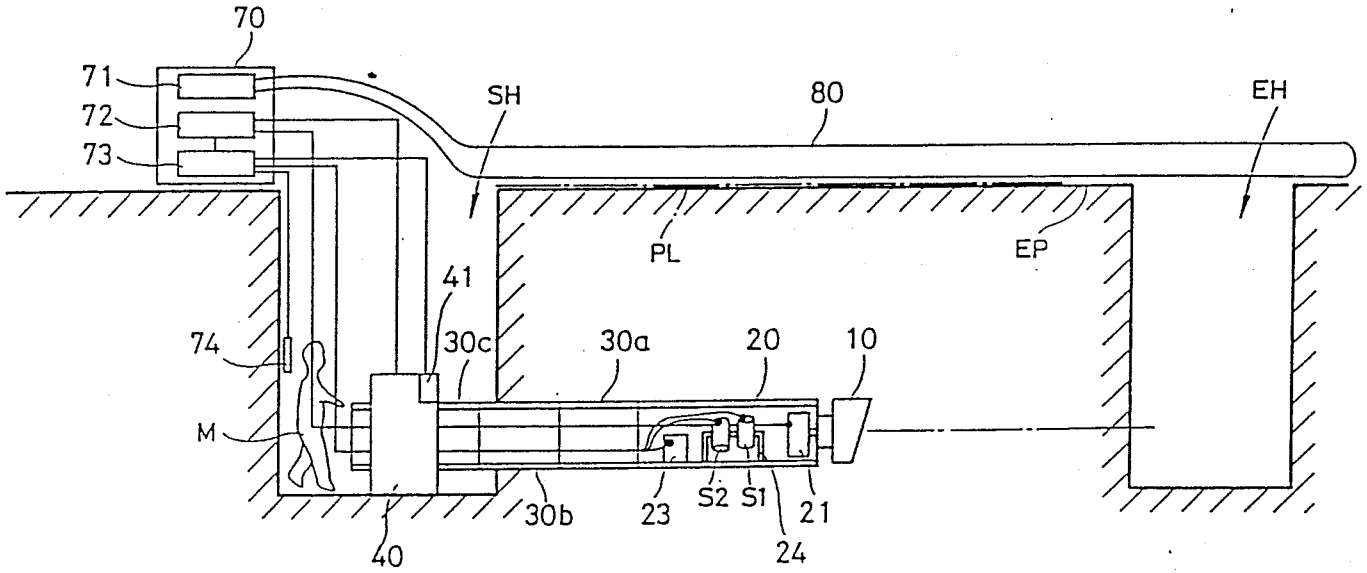
FIG. 1 is a cross-sectional vie schematically illustrating an outline of construction of an apparatus for controlling an underground excavator in accordance with an embodiment of the present invention.
Figure 2:
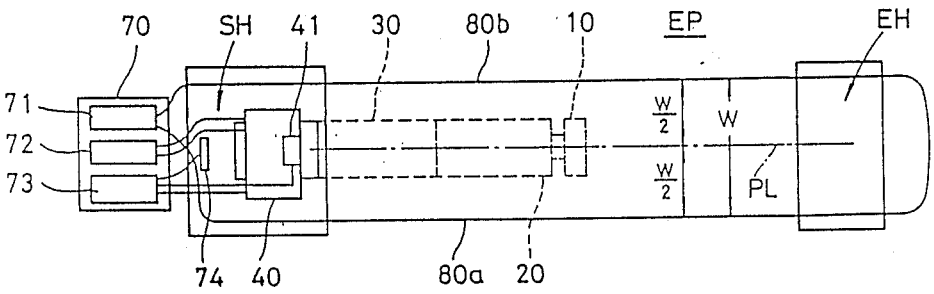
FIG. 2 is a plan view schematically illustrating construction of the apparatus in accordance with the embodiment as viewed from the above.
Figure 3:
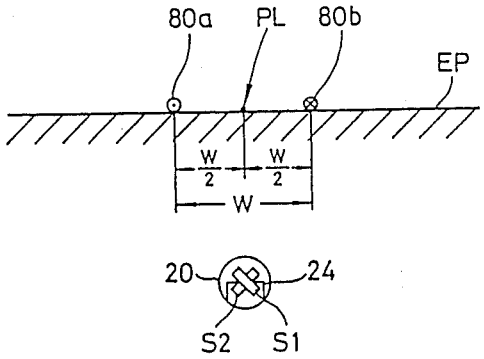
FIG. 3 is a fragmental sectional view illustrating the apparatus in accordance with the embodiment as viewed from the front side.

FIG. 1 schematically illustrates by way of a cross-sectional view rough construction of the apparatus in accordance with the embodiment inclusive an underground excavator which is kept in the same operative state as that shown in FIG. 5, FIG. 2 schematically illustrates by way of a plan view construction of the apparatus in accordance with the embodiment and FIG. 3 schematically by way of a fragmental sectional view construction of the apparatus in accordance with the embodiment as viewed in the direction of forward movement of the underground excavator. In the drawings, reference characters EP designates the ground surface, reference characters SH refer to a start pit, reference characters EH refer to a target pit, reference numeral 10 refers to an excavating head for the underground excavator, reference numeral 20 refers to a pilot head for the excavator, reference numeral 21 refers to a hydraulic motor accommodated in the pilot head 20 for the purpose of adjusting a turning angle $\psi$ of the excavating head 10 in accordance with the principle as shown in FIG. 10, reference numeral 23 refers to an inclination measuring instrument accommodated also in the pilot head 20 for detecting an inclination of the pilot head 20 relative to the horizontally extending surface, reference characters S1 and S2 refer to a magnetic field detecting element comprising, e.g. a solenoid, reference numeral 24 refers to an attitude supporting frame adapted to support the magnetic field detecting elements S1 and S2 in such a manner that the direction of detecting of magnetic fields to be performed by the magnetic field detecting elements S1 and S2 is kept in a relationship as shown in FIG. 6, reference numerals 30 (30*a*, 30*b*, 30*c*) refer to a rod pipe to be successively connected to the rear end of the pilot head 20 one after another, respectively, reference numeral 40 refers to a propelling jack for propelling the excavating head 10 and the pilot head 20 toward the target pit EH by allowing the rod pipes 30 to be successively displaced in the forward direction, reference numeral 41 refers to a propelled distance detector disposed at a proper location on the propelling jack 40 for counting the number of rod pipes 30 which have been used till now, reference numeral 70 refers to a main control board installed on the ground, reference numeral 80 refers to a magnetic field generating cable comprising a going line 80*a* and a returning line 80*b* laid over an excavation planned line PL on the ground surface EP while extending along the excavation planned line PL and in parallel with the same in an equally spaced relationship, reference numeral 71 refers to a sender accommodated in the main control board 70 to feed a required quantity of electric power to the magnetic field generating cable 80 for the purpose of generating the magnetic fields as shown in FIG. 6, reference numeral 72 refers to a hydraulic power source likewise accommodated in the main control board 70 to feed a required quantity of hydraulic power to the hydraulic motor 21 and the propelling jack 40, reference numeral 73 refers to a calculation/control section likewise accommodated in the main control board 70 for the purpose of collectively executing a number of calculation and control processings for the purpose of automatically correcting a forward movement course of the underground excavator in response to detection signals transmitted from the magnetic field detecting elements S1 and S2, the inclination measuring instrument 23 and the propelled distance detector 41 via suitable signal lines (wherein it is assumed that corrective signals associated with the detection signals are transmitted to the hydraulic motor 21 via the hydraulic source 72) and reference numeral 74 refers to a simplified actuating board disposed at a proper position in the start pit SH so as to allow un operator M staying on the bottom of the start pit SH to conveniently handle it so that commands indicative of start of propelling operation of the propelling jack 40 and stop of the same are issued therefrom in response to manual operation performed by manual handling of the operator M such as ON/OFF operation of switching means or the like (wherein it is assumed that command signals are transmitted to the hydraulic power source 72 via the calculation/control section 73 and further transmitted to the propelling jack 40 via the hydraulic power source 72). It should be noted that arrangement of the calculation/control section 73 in relation with the automatic correction of the forward movement course as described above is illustrated in more details in FIG. 4.

Figure 4:
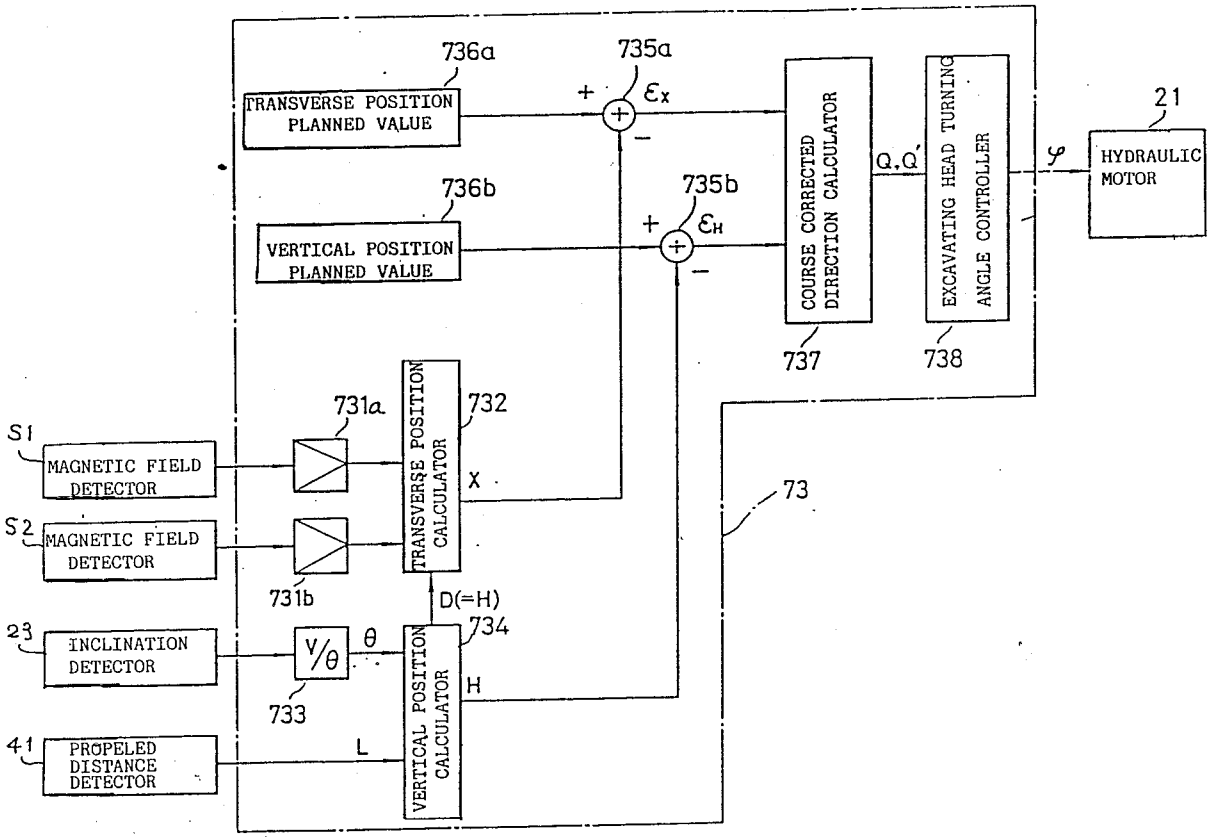
FIG. 4 is a block diagram illustrating construction of a calculation/control section for the apparatus in accordance with the embodiment.

Specifically, according to the calculation/control section 73 shown in FIG. 4, respective magnetic field detecting signals from the magnetic field detecting elements S1 and S2 are amplified as required by amplifiers 731*a* and 731*b* and thereafter they are received in a left/right position calculator 732. The left/right position calculator 732 is a calculator for looking for a position X to be assumed by the pilot head 20 as viewed in the transverse direction on the basis of a ratio of magnetic field detecting signal generated by one magnetic field detecting element to magnetic field detecting signal generated by other magnetic field detecting element, i.e. in accordance with the formula (1). Concrete functions of the calculator 732 will be described below.

Now, when the formula (1) is represented using W/2, D and X as noted below, the level ratio R can be represented by the following formula in connection with the relationships as represented by the formulas (2) to (6).

$$R = \frac{(W/2)^2 + D^2 - x(x - 2D)}{(W/2)^2 + D^2 - x(x + 2D)} \tag{8}$$

where

W/2: distance (known value) as measured from the excavation planned line PL to the magnetic field generating cable 80

D: depth at which the underground excavator (pilot head 20) is installed (=vertical position H of the latter derived from the formula (7))

x: horizontal displacement of the underground excavator (pilot head 20) from the excavation planned line PL (wherein the rightward direction is assumed as a positive direction)

Here, when an approximate inequality represented by $W^2+D^2>>x^2$ is introduced into the formula (8) to modify the latter in the form of a formula for obtaining a solution in view of the fact that a value of X usually assumes several centimeters in the presence of inequalities of $W>1$ m and $D>1$ m, the formula (8) is represented below in a modified manner.

$$R = \frac{(W/2)^2 + D^2 + 2 \times D}{(W/2)^2 + D^2 - 2 \times D} \tag{9}$$

Thus, x can be derived from the following formula (9).

$$x = \frac{R - 1}{R + 1} \cdot \frac{W^2 + D^2}{2D} \tag{10}$$

The left/right position calculator 73 shown in FIG. 4 functions to obtain the position X to be assumed by the underground excavator (pilot head 20) as viewed in the transverse direction by executing the calculation represented by the formula (10) on the basis of the level ratio R of one magnetic field detecting signal indicative of one detected magnetic field to other magnetic field detecting signal indicative of other detected magnetic field. Referring to FIG. 4, a value of the position X as viewed in the transverse direction is added to an adder 735*a* so that a deviation $\epsilon_x$ of the position assumed by the pilot head 20 as viewed in the transverse direction from a planned value relative to the transverse position of the pilot head 20 preset by a left/right position planned value setter 736*a* is obtained. In the illustrated embodiment, however, since a horizontal displacement relative to the planned value (excavation planned line PL) can be obtained directly by the left/right position calculator 732, a value of O is set as a planned value in the setter 736*a*. Accordingly, with respect to the values indicative of x, X and $\epsilon_x$, the following relationship is maintained among them.

$$x = X = \epsilon_x \tag{11}$$

Namely, in a case of the illustrated embodiment, a proper planned value relative to the transverse position is set in the setter 736a so as to allow it to be corrected in such a special case that the magnetic field generating cable 80 can not be uniformly laid along the excavation planned line PL due to presence of some obstructive articles on the ground surface. Next, the value of deviation $\epsilon_x$ (=X=x) relative to the transverse direction obtained in that way is added to a forward movement course correcting direction calculator 737. Incidentally, a value of D (indicative of depth at which the pilot head 20 is placed) in the formula (10) is given from an upper/-lower position calculator 734 to be described later as a positional information H relative to the underground excavator (pilot head 20) as viewed in the vertical direction.

On the other hand, a voltage generated by the inclination measuring instrument 23 corresponding to an amount of inclination of the pilot head 20 relative to the horizontally extending plane is converted into a pitching angle O by means of a voltage/angle converter 733 so that it is received in the upper/lower position calculator 734 along with a detection output from the propelled distance detector 41. The upper/lower position detector 734 is a calculator for looking for the existent value H relative to the vertical position assumed by the underground excavator (pilot head 20) in accordance with the formula (7). The calculated value H is added to the left/right position calculator 732 as an information D on the depth at which the pilot head 20 is placed and moreover added to the adder 735b so that a deviation $\epsilon_H$ from a planned value relative to the vertical position (depth) assumed by the underground excavator which has been preset in an upper/lower position planned value setter 736b is derived from the calculated value H. The deviation $\epsilon_H$ obtained in that way is added to a forward movement course correcting direction calculator 737 along with the foregoing deviation $\epsilon_X$ (=X=x) relative to the transverse direction.

The forward movement course correcting direction calculator 737 is a calculator for obtaining an angle of turning movement of the excavating head 10 to eliminate the deviation $\epsilon_X$ relative to the transverse direction as well as the deviation $\epsilon_H$ relative to the vertical direction obtained in the above-described manner on the basis of the geometrical relationship as shown in FIG. 10, i.e. a calculator for obtaining un information on an angle indicative of the target position Q' on the fore end part Q of the excavating head 10. The thus obtained information on an angle indicative of the target position Q' is added to an excavating head turning angle controller 738 along with the information on an angle indicative of the existent position relative to the fore end part Q of the excavator head 10 (representative of the position set as a target position at the preceding time). The excavating head turning angle controller 738 is activated to obtain a deviation relative to the received angular information, i.e. an angular deviation $\psi$ of the existent position of the fore end part Q of the excavating head 10 from the target position Q' so that a driving command is given to the hydraulic motor 21 so as to allow the excavating head 10 to be turned by the angular deviation $\psi$.

Since the apparatus in accordance with the embodiment is constructed and operated in the above-described manner, a forward movement course of the underground excavator is automatically corrected to follow the excavation planned value which has been preset when the apparatus is used for the purpose of excavating the underground. This makes it possible to easily perform a required excavating operation merely by a single operator M staying in the start pit SH by repeating the following steps.

first step: The operator M handles the simplified actuating board 74 to stop excavating operation to be performed by the underground excavator.

second step: After the operator M confirms that excavating operation is stopped, he connects a subsequent rod pipe 30 to the preceding one.

third step: After the operator M confirms that the subsequent rod pipe 30 is connected to the preceding one, he starts excavating operation by handling the simplified actuating board 74.

Incidentally, in the foregoing embodiment, the magnetic field generating cable 80 comprises a going line and a returning line which are laid in an equally spaced relationship from the excavation planned line PL. However, the present invention should not be limited only to this embodiment. Alternatively, for example, the cable 80 may be laid in such a manner that either of the going line and the returning line extends directly along the excavation planned line PL. In this case, however, it should be noted that other line which does not extend along the excavation planned line PL preferably should be parted away therefrom to such an extent that detection of the magnetic fields by the magnetic field detecting elements S1 and S2 is not adversely affected by the magnetic field generated by the above-mentioned line which does not extend along the excavation planned line PL. Further, in this case, a principle of measuring the position as viewed in the transverse direction where the magnetic field detecting elements S1 and S2 are placed in the underground is appreciably different from the foregoing one. When this principle is employed, a positional deviation of the underground excavator (particularly, the pilot head 20) from the excavation planned line PL as viewed in the transverse direction is measured on the basis of a characterizing feature that an intensity of magnetic field detected by the magnetic field detecting elements S1 and S2 (magnetic field detected thereby with respect to the magnetic field generated by one of the lines which is laid while extending along the excavation planned line PL) is different between the right half region and the left half region with the plane extending perpendicularly through the excavation planned line PL being used us a boundary therebetween. Accordingly, in this case, it is possible to measure the positional deviation using a single magnetic field detecting element which is placed such that the direction of detection of the magnetic field is oriented perpendicularly.

In general, a method of detecting a position where the underground excavator is installed in the underground, inclusive measurement of the position assumed by the underground excavator as viewed in the vertical direction should not be limited only to the foregoing embodiment but it can be selected arbitrarily. Thus, any other method may be employed, provided that a positional deviation of the underground excavator relative to the excavation planned value can be determined.

INDUSTRIAL APPLICABILITY

As will be apparent from the above description, an apparatus for controlling an underground excavator in accordance with the present invention assures that excavating operation can be performed using the underground excavator with the aid of a single operator staying on the bottom of a start pit. This makes it possible to completely obviate problems which have been hitherto apprehended. Another advantageous features provided by the present invention are as noted below.

(a) A personnel expenditure can be reduced.

(b) Since the operator staying on the bottom of a pit can issue commands indicative of start and stop of excavating operation at his own discretion, improved workability and safety in relation with excavating operation are assured.

What is claimed is:

1. An apparatus for controlling an underground excavator of which excavating head connected to the fore end of a rod pipe and of which pilot head are propelled by actuating a propelling jack in such a manner as to follow an excavation planned line extending over the ground surface while a plurality of rod pipes having a predetermined length are successively connected to one after another so that a tunnel is excavated between a start pit and a target pit along said excavation planned line, wherein said apparatus comprises:

a magnetic field generating cable laid on the ground surface corresponding to the excavating planned line, having a going line and a returning line maintained at an equal distance from said excavation planned line, to generate a predetermined intensity of magnetic field by causing a properly determined intensity of electric current to flow therethrough;

excavating angle correcting means adapted to obtain a positional deviation of the existent position assumed by said pilot head relative to an excavation planned value of the pilot head when the generated magnetic field is detected and then automatically correct an excavating angle of said excavating head on the basis of said positional deviation, said excavating angle correcting means comprising:

a first magnetic field detecting element immovably supported in the pilot head for detecting a magnetic field generated by the magnetic field generating cable utilizing an electromotive voltage induced by the magnetic field in such a manner that the direction of detecting of the magnetic field is inclined by a predetermined angle from a perpendicularly extending axis as viewed from the front side in the direction of propelling of the pilot head;

a second magnetic field detecting element immovably supported in the pilot head for detecting a magnetic field generated by the magnetic field generating cable utilizing an electromotive voltage induced by the magnetic field in such a manner that a direction of detecting of the magnetic field relative to said second magnetic field detecting element intersects the direction of detecting of the magnetic field relative to said first magnetic field detecting element at a predetermined angle in a linear symmetrical relationship with respect to the perpendicularly extending axis as viewed from the front side in the direction of propelling of the pilot head;

first calculating means for obtaining a positional deviation relative to the excavation planned line as viewed in the transverse direction as an amount of deviation from a balanced point in the magnetic field generated by the going line and the returning line of the magnetic field generating cable on the basis of a ratio of the value of a magnetic field detected by said first magnetic field detecting element to the value of a magnetic field generated by said second magnetic field detecting element;

inclination detecting means accommodated in the pilot head for detecting an inclination of the pilot head relative to the horizontally extending plane;

propelled distance detecting means for detecting a propelled distance of the pilot head from the start pit on the basis of the number of used rod pipes;

second calculating means for obtaining a positional deviation of the pilot head as viewed in the vertical direction relative to the depth planned value preset from the ground surface on the basis of a detected value of said inclination detecting means and a detected value of said propelled distance detecting means;

whereby an excavating angle of said excavating head is automatically corrected on the basis of positional deviations obtained by said first and second calculating means; and commanding means disposed in said start pit as a remote actuating unit to issue commands indicative of start and stop of propelling operation to be performed by said propelling jack by manually handling said commanding means in a suitable manner.

2. An apparatus for controlling an underground excavator as claimed in claim 1, wherein said predetermined angle formed by the first and second magnetic field detecting elements relative to the perpendicularly extending axis as viewed from the front side in the direction of propelling of the pilot head is 45 degrees.

* * * * *